US006066247A

United States Patent [19]

Sharma

[11] Patent Number: 6,066,247

[45] Date of Patent: May 23, 2000

[54] METHOD FOR PRODUCING ALUMINUM METAL FROM ALUMINUM TRICHLORIDE

[76] Inventor: Ram A. Sharma, 2951 Homewood Dr., Troy, Mich. 48098

[21] Appl. No.: 09/065,636

[22] Filed: Apr. 23, 1998

[51] Int. Cl.[7] ..... C25C 3/06

[52] U.S. Cl. ..... 205/372; 205/394

[58] Field of Search ..... 205/372, 394

[56] References Cited

U.S. PATENT DOCUMENTS

| | | | |
|---|---|---|---|
| 3,103,472 | 9/1963 | Slatin | 205/394 |
| 3,518,172 | 6/1970 | Layne et al. | 205/394 |
| 3,725,222 | 4/1973 | Russell et al. | 205/394 |

FOREIGN PATENT DOCUMENTS

| | | | |
|---|---|---|---|
| 891369 | 12/1959 | United Kingdom | 205/394 |

*Primary Examiner*—Kathryn Gorgos
*Assistant Examiner*—Thomas H. Parsons
*Attorney, Agent, or Firm*—Reising, Ethington, Barnes, Kisselle, Learman & McCulloch, P.C.

[57] ABSTRACT

A method is provided for the electrolytic production of aluminum metal from aluminum trichloride starting material. A molten electrolytic solution of mixed chloride-fluoride salts is formed in a reaction vessel into which the aluminum trichloride feed material is added. The fluoride component of the electrolyte reacts spontaneously with the aluminum trichloride, producing aluminum fluoride and a chloride salt. The aluminum fluoride is advantageously stored in a non-volatile state in solution in the electrolyte. The aluminum fluoride is then electrolytically reduced to yield aluminum metal and a fluoride salt.

13 Claims, 6 Drawing Sheets

METHOD FOR PRODUCING ALUMINUM METAL FROM ALUMINUM TRICHLORIDE

This invention relates to a method of producing aluminum from aluminum trichloride in a molten salt electrolyte solution.

BACKGROUND OF THE INVENTION

Fused salt electrolysis processes are used to produce metals. These processes can be distinctively divided into two categories. In one category a chloride is used as the feed material which is dissolved in a molten chloride based electrolyte and then decomposed electrolytically to produce metal on a suitable cathode and chlorine on a suitable anode. The typical example of this type of process is the electrolytic production of magnesium. In the second category, an oxide feed material is dissolved in a molten fluoride-based electrolyte and then electrolytically decomposed to produce metal on an appropriate cathode and oxygen on a carbon anode. The carbon anode reacts with the oxygen to form carbon dioxide and is consumed in the process. The typical example of this type of process is the electrolytic production of aluminum by the Hall-Heroult process.

No process is known heretofore in which a chloride feed material is dissolved in a fluoride-based electrolyte bath and then decomposed electrolytically to produce metal on a suitable cathode and chlorine on a graphite anode. Some advantages of such an approach would be: chlorides are likely to have higher solubilities in the fluoride melts in comparison with the limited solublities of oxides in these melts; the cell operating temperatures should be lower; and in some cases, energy consumption may be lower.

Aluminum has been traditionally produced by dissolving alumina in a cryolite based electrolyte and decomposing it electrolytically at about 1000° C. ever since the invention of the Hall-Heroult process in 1886. The cell operates at a comparatively high temperature and produces fluoride compounds which pose serious health hazards.

A process using aluminum chloride as feed material and a chloride-fluoride mixed electrolyte for dissolving and electrolyzing the chloride feed, may eliminate both the problems mentioned above. In addition, there would be about 25% savings in the energy consumption for producing aluminum, as will be noted later on.

In the electrolytic production of aluminum according to the traditional Hall-Heroult process, alumina ($Al_2O_3$) is used as feed material. It is prepared from bauxite. In the commonly used Bayer Process, bauxite is finely ground in a ball-mill and stored in large bins. The ground bauxite is next mixed with aqueous sodium hydroxide (NaOH) solution, of specific gravity 1.45, in a vessel fitted with stirrers. After intimate stirring, the mixture is pumped into steam-jacketed autoclaves and digested for 2–8 hours under a pressure of 50 to 70 lbs per square inch, at a temperature of 150 to 160° C. The alumina of the bauxite reacts with NaOH, forming sodium aluminate which goes into solution. After the digestion is completed, the liquor from the autoclaves is forced into large iron settling tanks and held 4–5 hours to allow settling of solid impurities. This settled mass is called "red mud" and consists of undissolved alumina, ferric oxide, titania, silica etc., from the bauxite.

The sodium aluminate liquor from the tanks is diluted from specific gravity 1.45 to 1.23, filtered and run into large precipitation tanks to precipitate aluminum hydroxide. Sodium aluminate itself decomposes into aluminum hydroxide and sodium hydroxide, but the decomposition is accelerated by heating, stirring, and providing freshly prepared aluminum hydroxide seeds in the precipitation tanks. The aluminum hydroxide precipitation can take up to 60 hours. The aluminum hydroxide is separated by filtration and dried in cylindrical rotary kilns at 1000 to 1100° C. to prepare substantially pure anhydrous aluminum oxide for use in the electrolytic cells.

The reduction cell or "pot" is a strong steel box, usually rectangular in shape, and is lined with refractory insulation, which surrounds an inner baked carbon lining. Thermal insulation is adjusted to provide sufficient heat loss to freeze an electrolyte coating on the inner walls, to protect them from the corrosive electrolyte attack. The bottom is not coated, and remains bare for electrical contact with the molten aluminum cathode. Steel collector bars are joined to the carbon container cathode, at the bottom, to conduct electric current from the cell. Current enters the cell through prebaked carbon anodes, or through a continuously self-baking Soderberg anode.

The carbon lined pot serves as the cathode. The lining is made by two methods. In one method, it is made by ramming a hot mixture of pulverized metallurgical coke with tar and soft pitch binders into the steel shell, using a suitable cast iron former to give the cavity the desired shape. The entire pot is baked in a furnace at about 600 to 800° C. In the second method, preformed and prebaked carbon blocks are used to build up the lining, the blocks being cemented together with a mixture of tar, pitch, and ground coke. The cathode carries the current to the metallic aluminum. Overheating and local stresses cause it to crack and degenerate. Broken pieces of lining then float in the bath and cause partial short circuits between the anodes and the metal. Breaks in the lining permit the molten Al to attack the steel shell or collector box with the resultant dissolution of the iron by the Al. When this happens, the cell is removed and repaired. The carbon lining is porous and absorbs nearly its own weight of the fused electrolyte. When the cells are repaired, the old lining is broken out. The fused electrolyte is recovered by burning off the carbonaceous materials in multi-hearth furnaces. Cells may operate as long as 3 years, without repair or replacement.

The anodes are manufactured using calcined petroleum coke or hard pitch coke instead of foundry coke. Prebaked anodes are produced by molding petroleum coke and coal tar pitch binder into blocks (typically 70 cm×125 cm×50 cm) and baking to 1000–1200° C. Steel stubs seated in the anode support the anode in the electrolyte and conduct electric current into the anodes. Electric resistivity of the anodes ranges from 5–6 Ω-m anode current density 0.65–1.3 A/cm$^2$.

The Soderberg type of anodes are continuously baked. The anode briquettes are carried to the pots in portable hoppers, elevated and dumped into the top of the anode shell. The temperature at the top of the pot is high enough to melt the briquettes. The temperature in the lower part of the anode shell is high enough to distill the volatile matter in the briquettes and to bake the anode into a single solid block. The anode is lowered into the pot, at a rate which compensates for the carbon used during electrolysis. Its resistivity is about 30% higher than prebaked anodes. Current density is lower, ranging from 0.65–0.9 A/cm$^2$.

It is believed that alumina dissolves in cryolite at low concentrations by the reaction, $$Al_2O_3+4AlF_6^{3-}\rightarrow 3Al_2O\ F_6^{2-}+6F^- \quad (1)$$

and at higher concentrations by the reaction, $$2\ Al_2O_3+2Al\ F_6^{3-}\rightarrow 3\ Al_2O_2\ F_4^{2-} \quad (2)$$

Ion transport measurements indicate that $Na^+$ ions carry most of the current. This is consistent with the lower decomposition potential of sodium oxide ($Na_2O$) than that of aluminum oxide ($Al_2O_3$) in these ionic melts. Al is deposited on the cathode by the reaction, $$12Na^++4AlF_6^{3-}+12e^-\rightarrow 12\ (Na^++F^-)+4\ Al+12\ F^- \quad (3)$$

Oxyfluoride ions are discharged at the anode forming $CO_2$ by the reactions, $$2Al_2O_2\ F_4^{2-}+C\rightarrow CO_2+2Al_2O\ F_4+4\ e^- \quad (4)$$

$$Al_2O\ F_4+Al_2O\ F_6^{2-}\rightarrow Al_2O_2\ F_4^{2-}+2AlF_3 \quad (5)$$

Summation of equations (1) to (5) gives the overall reaction, $$2Al_2O_3+3\ C\rightarrow 4\ Al+3\ CO_2 \quad (6)$$

Faraday efficiency is reported to be 85–95%. Loss of efficiency is reported to be caused by reduced species (Al, Na, or AlF) dissolving at the cathode and being transported toward the anode where these species are reoxidized by $CO_2$, forming CO and metal oxide which can dissolve in electrolyte.

Aluminum is produced by carrying out electrolysis of alumina dissolved in cryolite ($3NaF.AlF_3$) based electrolyte at about 1000° C. using a carbon anode and a layer of molten aluminum as cathode. The electrolyte consists of cryolite, 4–8 wt % $CaF_2$, 5–13 wt % $AlF_3$, 0–7 wt % LiF, and 0–5 wt % $MgF_2$. Joule heating from the flow of electric current is more than enough to maintain the melt temperature. Molten aluminum (sp. gr. 2.29 at 1000° C.) is heavier than the electrolyte (sp. gr. ~2.095 at 1000° C.). Therefore, a layer of aluminum varying in thickness from a fraction of an inch to 4 to 5 inches serves as the cathode at the bottom of the cell. A layer of 6–12 inches of molten cryolite containing 2–5% alumina in solution serves as the electrolyte. The lower end of the carbon anode is kept 2–4 inches above the upper surface of the layer of molten aluminum. During the electrolysis, aluminum forms at the aluminum cathode, and oxygen forms at the carbon anode. Oxygen reacts with the carbon to form carbon dioxide.

Over the molten electrolyte is maintained a crust of frozen electrolyte mixed with alumina which is added as the feed. As the concentration of alumina in the electrolyte decreases by its consumption in the electrolysis, alumina is added to the electrolyte by breaking the frozen layer, on top of which has previously been distributed a layer of alumina. Alumina has to be fine enough to be maintained in suspension long enough to be dissolved by the agitation of the electrolyte. The time required for 200-mesh alumina to dissolve completely in fused electrolyte has been found experimentally to vary between 1.5 to 9 minutes, depending on the temperature, degree of saturation of electrolyte, and the character of alumina. The theoretical emf for the dissociation of alumina in the cryolite is 2.18 V at 1000° C., but it becomes 2–3 times this value in the cell operation.

Cathode current densities vary between 300–600 A/ft$^2$ (0.32 to 0.65 A/cm$^2$) and anode current densities, based on the face area, vary between 5–7 A/in$^2$ (0.77 to 1.1 A/cm ). Each cell takes a large current at a low voltage; a number of cells are arranged in a line in series. The line voltage may be 600–800 V. A line may contain 120 to 168 pots in series. Cell amperages are 34,000 to 130,000 amperes. Current efficiency varies between 90 and 95%. The power requirements for aluminum are 7.8 to 8.5 kWH dc or 8.3 to 9 kWH ac per pound. Carbon from 0.6 to 0.3 lb, alumina 2 lbs, and 0.03 to 0.05 lb of cryolite, are required for one pound of aluminum production. At 100% efficiency, 1000 amp, produces each 24 hr day, 17.746 lb Al and 21.689 lb $CO_2$, equivalent to 800 cu. ft at 960° C.

In 1973, Alcoa announced a new electrolytic process for producing aluminum, (the Alcoa process) using an alkali and alkali earth chloride-based electrolyte and aluminum trichloride ($AlCl_3$ ) feed material. The process consisted of 1) production of very pure alumina by the Bayer process 2) chlorination of alumina for the production of aluminum trichloride and 3) the electrolysis of the aluminum trichloride dissolved in the electrolyte. Alumina with carbon was chlorinated in a reactor at 700–900° C. The resultant aluminum chloride was purified and then stored in the crystalline state in a tank. The cell consisted of a steel enclosure, lined with a refractory material. The refractory material was believed to be silicon oxynitride. The metal produced was collected in a graphite compartment. The operating temperature was 700±30° C. A typical composition of the electrolyte is reported to be 5 wt % $AlCl_3$, 53 wt % NaCl, 40 wt % LiCl, 0.5 wt % $MgCl_2$, 0.5 wt % KCl and 1 wt % $CaCl_2$.

Several bipolar electrodes were stacked in the cell on top of each other at an interpolar distance of approximately 1 cm. The anodically evolved chlorine was used to sweep the aluminum from the cathodes. The pumping effect of the chlorine bubbles also caused melt circulation and supply of new electrolyte to the electrode compartments. The aluminum settled in the bottom of the cell by falling countercurrent to the chlorine gas. Alcoa reported a current density of 0.8–2.3 A/cm and a typical single-cell voltage of 2.7 V in comparison with the reversible decomposition potential of 1.8 V. The ohmic voltage drop in the electrolyte was about 0.5 V. The energy consumption was reported to be about 9 kWH/kg of Al including the chlorination step energy consumption.

Though the Alcoa chloride electrolysis process was theoretically promising, several difficult technical problems could not be solved satisfactorily. One difficult problem was the production and handling of the very pure and water-free aluminum trichloride. The process is no longer known to be in operation.

SUMMARY OF THE INVENTION

The present invention uses the following criteria for the development of the new process.

a) The new process should deviate minimally from the existing production process in order to have a very high probability of successful development;

b) The new process should use an electrolyte similar to that of the existing process, and therefore can use the existing equipment, with minor modifications;

c) The new process should use inexpensive, easily available, non-hygroscopic raw materials as much as possible;

d) The new process should use as feed material a compound that will reduce the energy consumption; and e) The new process should reduce the number of operations involved to minimize capital investment.

It is an object of the invention to provide a method for electrolytically producing aluminum in which gaseous aluminum trichloride ($AlCl_3$) is used as the feed material in the place of alumina ($Al_2O_3$ ) of the existing process. The standard decomposition potential of $AlCl_3$ is about 0.5 V lower than that of $Al_2O_3$ . The lower decomposition potential of $AlCl_3$ plus the lower anode overvoltage is believed to reduce the energy consumption by about 25% for aluminum production in comparison to the energy consumption of the traditional Hall-Heroult process.

It is essential, for the successful electrolytic decomposition of $AlCl_3$, to dissolve it in an electrolyte, store it, and then decompose it, without decomposing any other component of the electrolyte. This is done according to the invention by using electrolyte melts comprising fluorides and a chloride. A suitable fluoride is used in the electrolyte to chemically react with the gaseous $AlCl_3$ feed material, for dissolving and storing it in a non-volatile state. The fluoride ions also cleanse the aluminum produced to the maximum possible extent. A chloride is used in the electrolyte to produce a metal which will generate Al by chemically reacting with aluminum fluoride ($AlF_3$).

Thus, according to the invention, there is provided a method for producing aluminum metal in which aluminum trichloride (preferably gaseous) is added to a molten mixture of chloride-fluoride based electrolyte salt solution whereupon the aluminum trichloride reacts spontaneously with the fluoride component producing a chloride salt and aluminum fluoride which is dissolved in the electrolyte. The aluminum fluoride is electrolytically reduced to produce aluminum and a fluoride salt.

According to a further feature of the invention, the molten electrolyte salt solution comprises a mixture of alkali metal chloride, alkali metal fluoride, and alkali metal cryolite, with the alkali metals comprising preferably sodium, lithium and potassium. The ternary electrolyte system is preferably a eutectic composition with the electrolyte maintained at an operating temperature above the eutectic temperature.

BRIEF DESCRIPTION OF THE DRAWINGS

The objects and advantages of the invention will be understood in view of the following detail description and the figures, in which.

DETAILED DESCRIPTION

Figure 1:
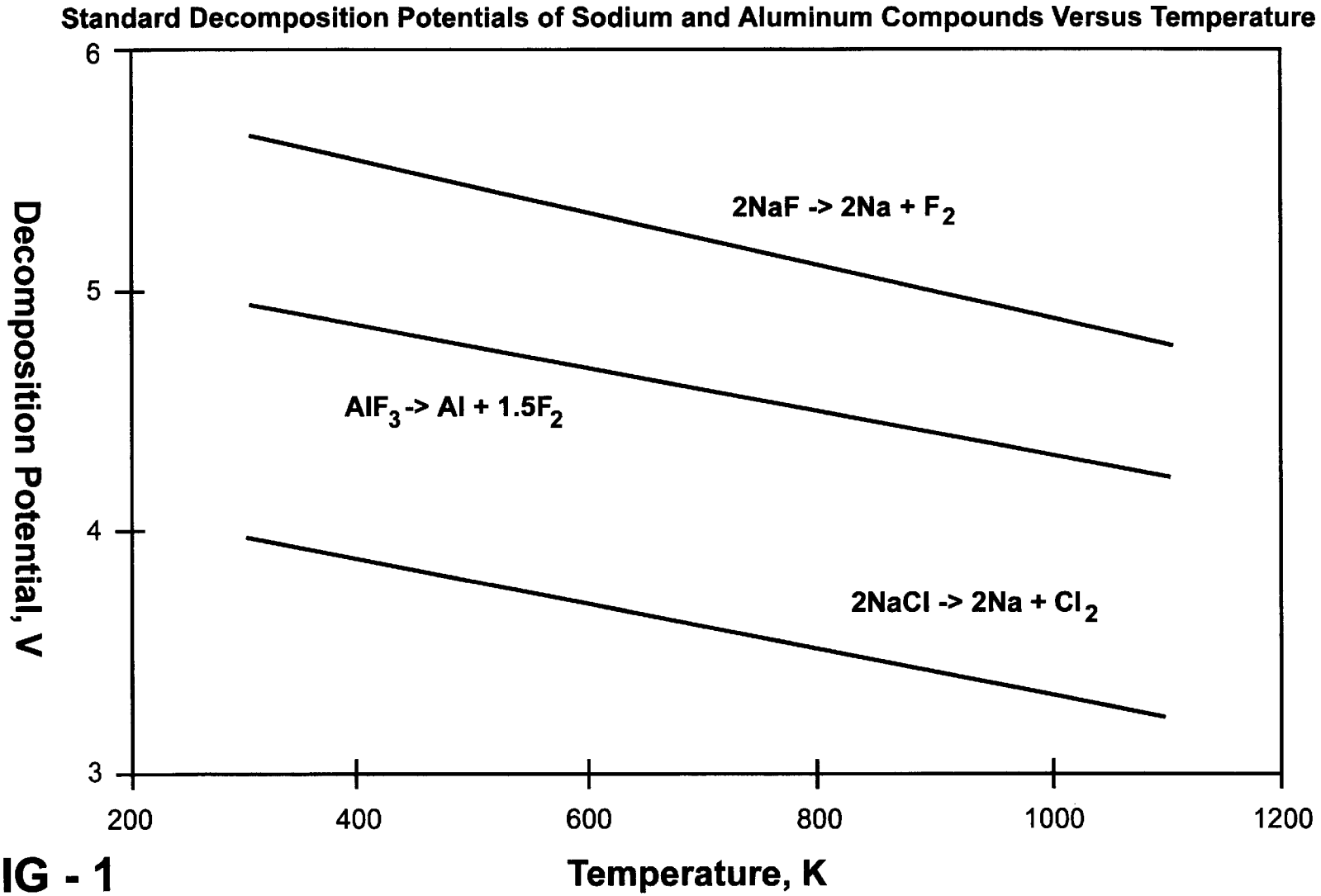
FIG. 1 is a graph showing the decomposition potential of various salts versus temperature.

A method for producing aluminum from aluminum chloride starting material involves preparing a mixture of chloride-fluoride molten electrolyte salt solution in a reaction vessel, and adding to the vessel the aluminum chloride feed material which reacts spontaneously with the fluoride component of the electrolyte, producing chloride salt and aluminum fluoride dissolved in the electrolyte solution. The aluminum fluoride is then electrolytically decomposed to produce aluminum metal and a fluoride salt.

The combination of the aluminum chloride feed material and the electrolyte solution is unique in that the electrolyte is one having a fluoride salt constituent which, when the aluminum trichloride is added to the electrolyte, readily and spontaneously reacts with the aluminum trichloride converting it into aluminum fluoride, thus dissolving and storing the aluminum trichloride in a non-volatile state in the electrolyte solution. Converting the initial feed material to aluminum fluoride eliminates aluminum chloride as a component of the electrolyte solution, overcoming the problems associated with the high volatility and low ionic conductivity associated with the electrolytic reduction of aluminum trichloride, according to traditional techniques. The aluminum fluoride is advantageously stored in a non-volatile state in the electrolyte and its ionic conductivity is greater than that of aluminum trichloride, increasing the efficiency and reducing the energy consumption in the production of aluminum.

A preferred electrolytic solution according to the invention is one that includes a mixed fluoride-chloride salt, preferably alkali metal fluoride and chloride salts. Still further it is preferred that the electrolyte solution comprise a ternary eutectic composition of such alkali metal chloride and fluoride salts along with an alkali metal cryolite compound, the alkali metals selected preferably from the group consisting essentially of sodium, lithium and potassium.

According to a particular embodiment, the ternary sodium chloride (NaCl)-sodium fluoride (NaF) -aluminum fluoride ($AlF_3$) phase diagram indicates a ternary eutectic of 51.85 wt % NaCl, 15.6 wt % NaF and 32.55 wt % of $Na_3AlF_6$, at 674° C. This eutectic melt is believed to be suitable for use as an electrolyte in the cells operating at about 750° C.

The standard free energy change of the reaction of $AlCl_3$ with NaF has a sufficient negative standard free energy change that the reaction is spontaneous. Thus, on addition of $AlCl_3$ to the above ternary melt electrolyte, the following reaction, $$AlCl_3+3NaF \rightarrow AlF_3+3NaCl \quad (7)$$

should occur spontaneously, forming aluminum fluoride and sodium chloride. The melt now consists of sodium chloride (NaCl), sodium fluoride (NaF) and aluminum fluoride ($AlFl_3$ ) and does not have the $AlCl_3$ as a component, with its volatility and low ionic conductivity problems. On applying a suitable potential to carry out the electrolysis, NaCl should decompose electrolytically by the reaction, $$3NaCl \rightarrow 3Na+1.5\ Cl_2 \quad (8)$$

as is indicated by its decomposition potential, which is lower than that of any other component of the electrolyte, as shown in FIG. 1.

Figure 3:
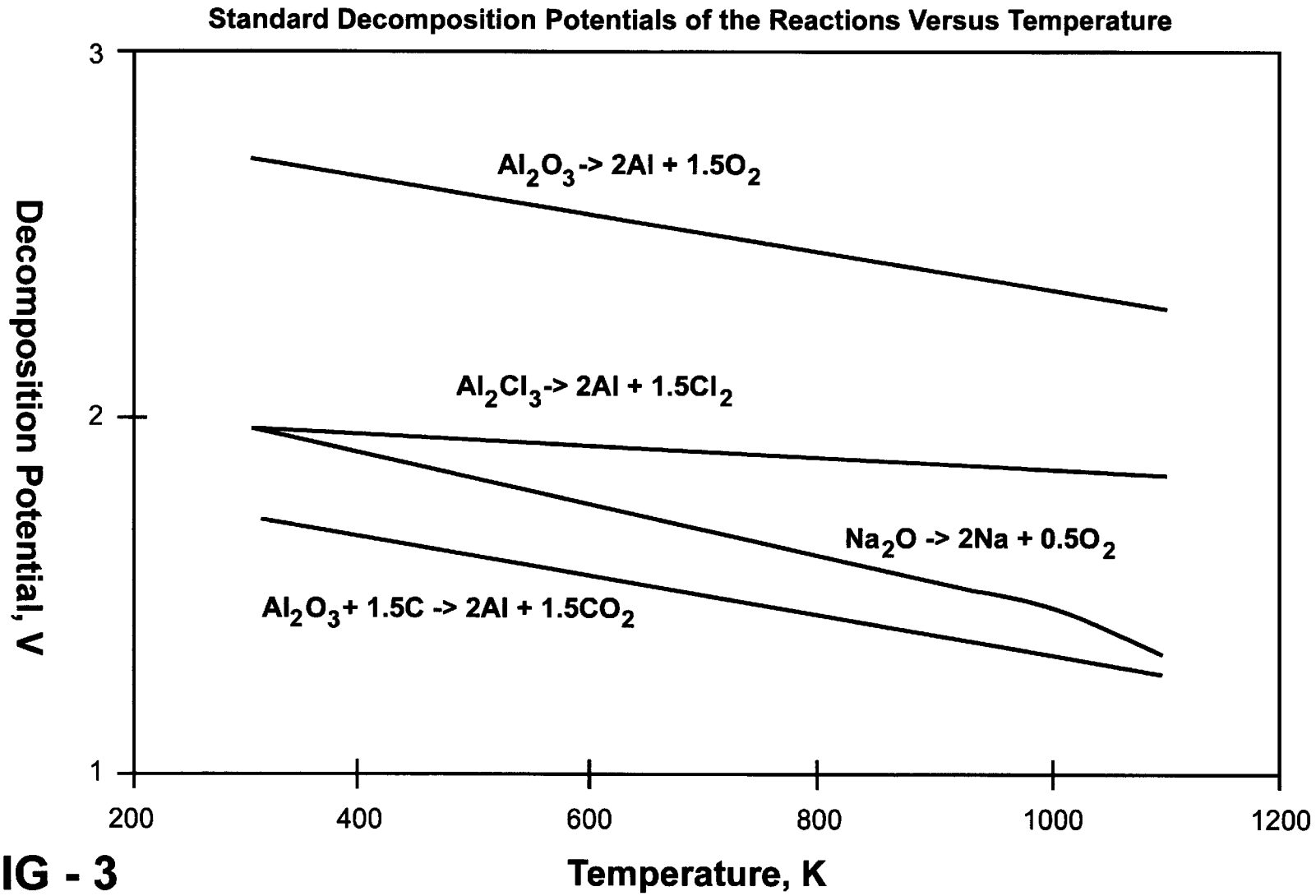
FIG. 3 is a graph showing the decomposition potential of various compounds as a function of temperature.

The electrolytically produced sodium (Na), by reaction (8), should react with aluminum fluoride ($AlF_3$) by the reaction, $$AlF_3+3Na \rightarrow 3NaF+Al \quad (9)$$

forming sodium fluoride (NaF) and Al. The spontaneity of this reaction is indicated by its negative standard free energy change, shown in FIG. 2. The net result of reactions (7) to (9) is the reaction, $$AlCl_3 \rightarrow Al + 1.5\ Cl_2 \quad (10)$$

whose standard decomposition potential as a function of temperature is given in FIG. 3. During electrolysis, $AlCl_3$ should decompose without decomposing any of the other components of the electrolyte melt, as indicated by its lowest standard decomposition potential (FIGS. 1 and 3).

The binary lithium chloride-lithium fluoride (LiCl-LiF), sodium chloride-sodium fluoride (NaCl-NaF) and potassium chloride-potassium fluoride (KCl-KF) systems are very similar, i.e. each system forms a simple eutectic. The binary lithium fluoride-aluminum fluoride ($LiF-AlF_3$), sodium fluoride-aluminum fluoride ($NaF-AlF_3$) and potassium fluoride-aluminum fluoride ($KF-AlF_3$ ) systems are also similar, i.e. each system forms a cryolite compound and a eutectic between the alkali fluoride and the compound. The binary lithium chloride-lithium cryolite ($LiCl-Li_3\ AlF_6$), sodium chloride-sodium cryolite ($NaCl-Na_3\ AlF_6$), and potassium chloride-potassium cryolite ($KCl-K_3\ AlF_6$), are similar too, i.e., each system forms a simple eutectic.

Therefore, ternary $LiCl-LiF-Li_3\ AlF_6$, $NaCl-NaF-Na_3\ AlF_6$, $KCl-KF-K_3\ AlF_6$ systems should also be very similar. The ternary $Li_3\ AlF_6-(LiF)_3-(LiCl)_3$ phase diagram indicates a large region of melts having melting points below 700° C.

Figure 4:
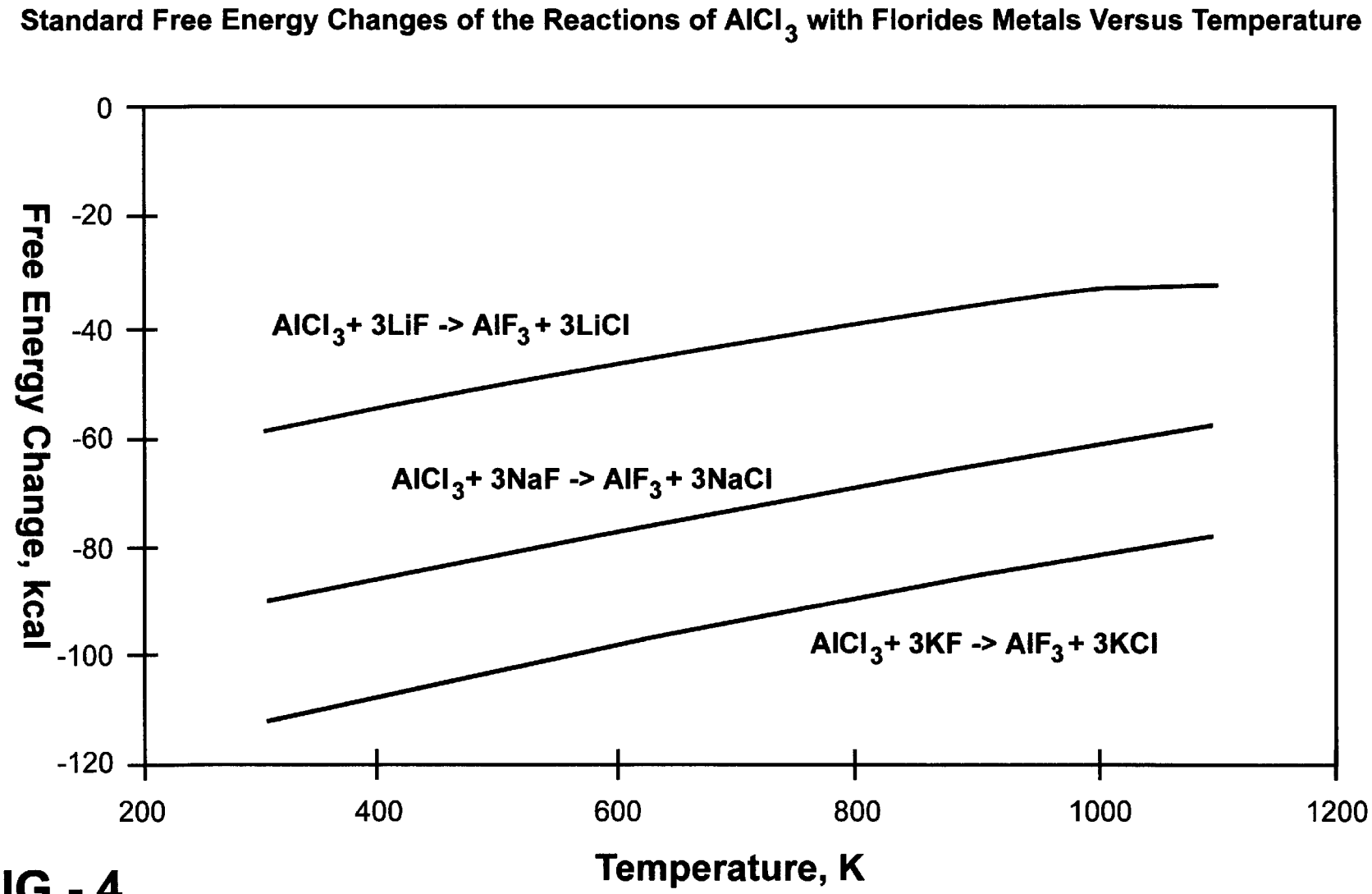
FIG. 4 is a graph showing the free energy change of various reactions as a function of temperature.

Using the above phase diagrams, appropriate melts of $LiCl-LiF-\ Li_3AlF_6$ and $KCl-KF-K_3AlF_6$ can be found as suitable electrolytes, for producing aluminum at temperatures between 675–800° C. In the case of low melting electrolytes consisting of $LiCl-LiF-\ Li_3AlF_6$ and $KCl-LiF-Li_3AlF_6$ melts, the reactions analogous to those described for the $NaCl-NaF\ -\ Na_3AlF_6$ electrolytes are as follows. On addition of gaseous $AlCl_3$ in the cell, the reaction, $$AlCl_3 + 3LiF \rightarrow AlF_3 + 3LiCl \quad (11)$$

should occur, spontaneously, as indicated by its negative free energy change (FIG. 4). On applying a suitable potential to carry out the electrolysis, LiCl will decompose electrolytically by the reaction, $$3LiCl \rightarrow 3Li + 1.5\ Cl_2 \quad (12)$$

Figure 5:
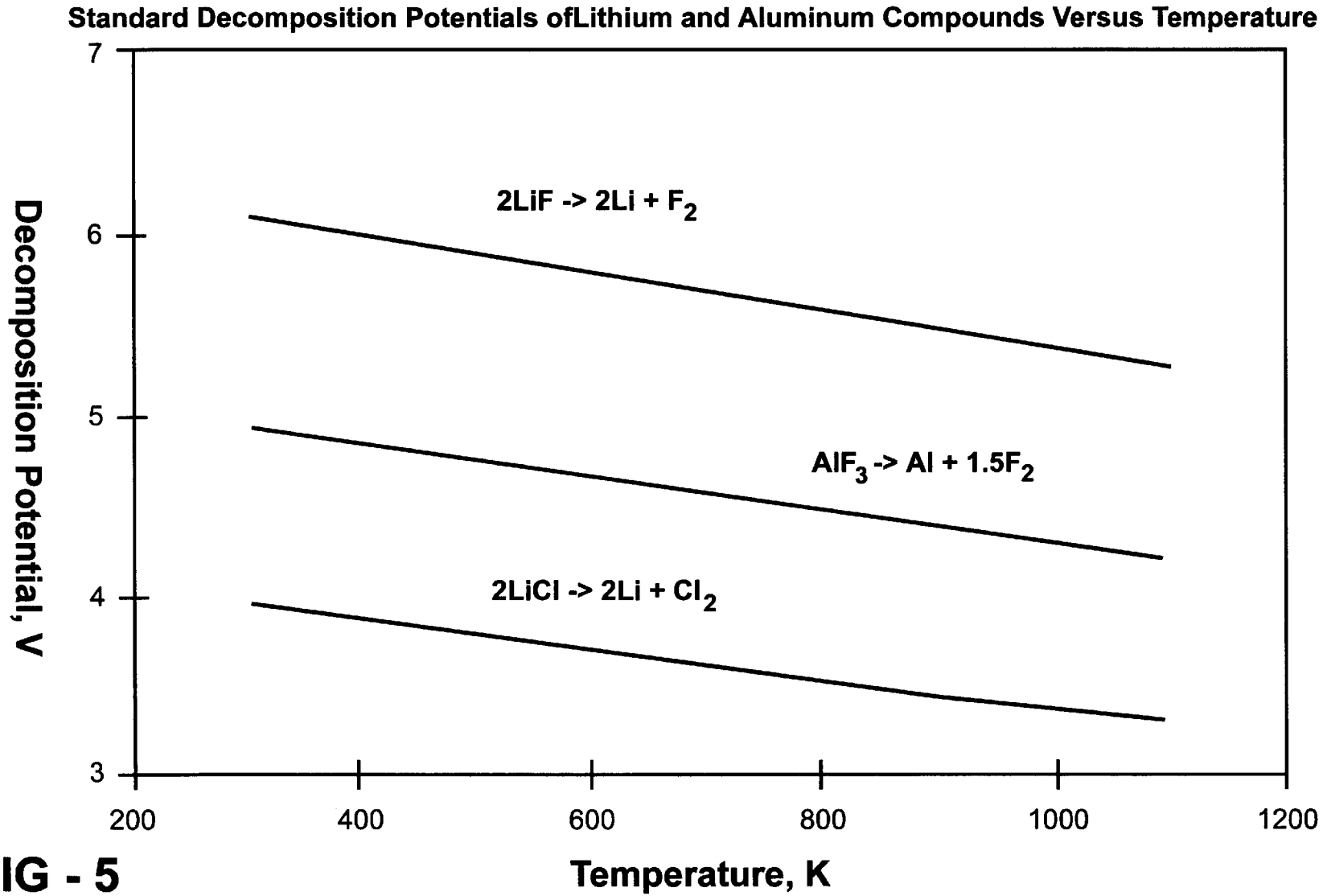
FIG. 5 is a graph showing the decomposition potential of various compounds as a function of temperature.

This is indicated by its standard decomposition potential, which is lower than that of any other component of the electrolyte in FIG. 5. The electrolytically produced lithium should react with $AlF_3$ in the electrolyte melt producing aluminum by the reaction, $$AlF_3 + 3Li \rightarrow 3LiF + Al \quad (13)$$

Figure 2:
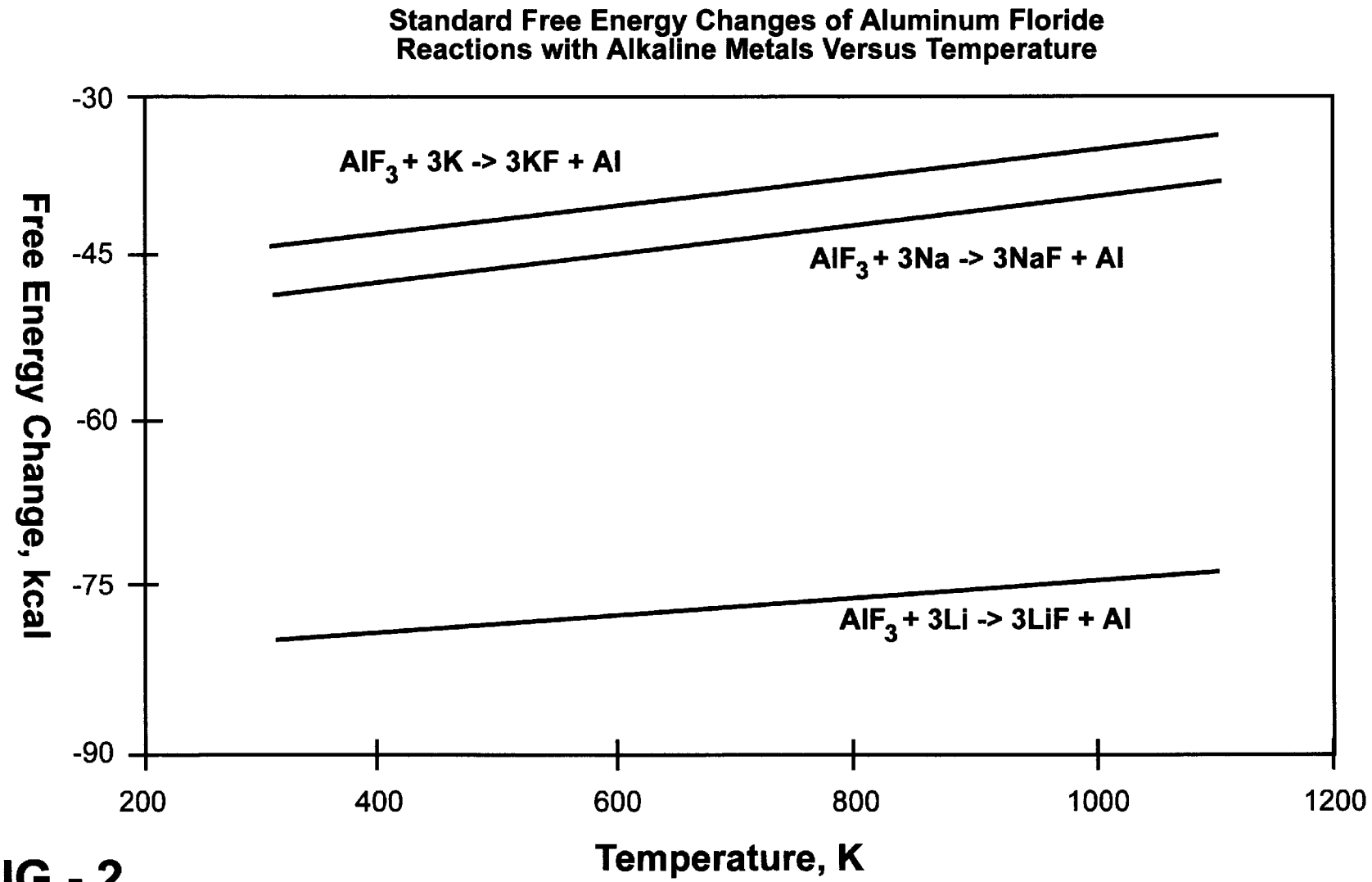
FIG. 2 is a graph showing the free energy change of certain reactions versus temperature.

The possibility of this reaction is again indicated by its negative standard free energy change shown in FIG. 2. The net result of reactions (11) to (13) is again the electrolytic decomposition of $AlCl_3$ by reaction (10), as described earlier.

In the case of the electrolyte melts of higher melting temperatures, i.e. $KCl-AlF_3-K_3AlF_6$, the reactions are as follows. Upon addition of $AlCl_3$ feed material to the electrolyte in the cell, the reaction, $$AlCl_3 + 3KF \rightarrow AlF_3 + 3KCl \quad (14)$$

should occur, spontaneously, as is indicated by its negative standard free energy change (FIG. 4). On applying a suitable potential to carry out the electrolysis, KCl will decompose electrolytically by the reaction, $$3KCl \rightarrow 3K + 1.5\ Cl_2 \quad (15)$$

Figure 6:
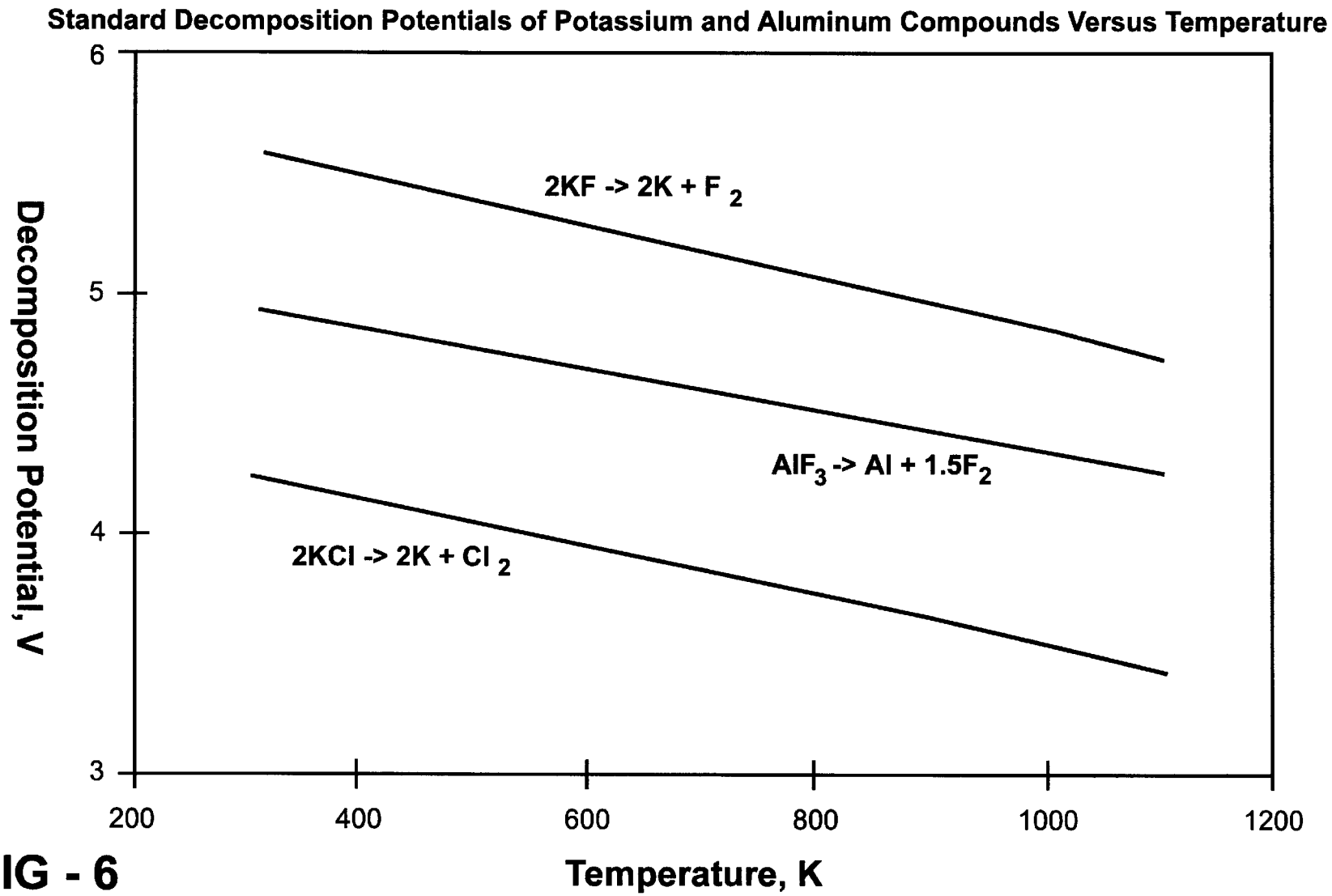
FIG. 6 is a graph showing the decomposition potential of various potassium compounds as a function of temperature in relation to the decomposition of aluminum fluoride.

This is indicated by its standard decomposition potential in FIG. 6, which is lower than that of any other component of the electrolyte. The electrolytically produced potassium (K) should react with $AlF_3$ in the electrolyte melt, producing aluminum by the reaction, $$AlFl_3 + 3K \rightarrow 3KF + Al \quad (16)$$

The possibility of this reaction is again indicated by its negative standard free energy change, as shown in FIG. 2. The net result of reactions (14) to (16) is again the electrolytic decomposition of $AlCl_3$ by reaction (10) as described before.

Cryolite ($Na_3AlF_6$) is reported to dissociate as follows:

$$Na_3AlF_6 \rightarrow 3Na^+ + AlF_6^{3-} \quad (17)$$

and $$AlF_6^{3-} \leftrightarrow AlF_4^- + 2F \quad (18)$$

Sodium chloride dissociates as, $$NaCl \rightarrow Na^+ + Cl^- \quad (19)$$

and sodium fluoride dissociates as, $$NaF \rightarrow Na^+ + F^- \quad (20)$$

Therefore the melts composed of NaCl, NaF, and $Na_3AlF_6$ should consist of $Na^+$, $Cl^-$, $F^-$, $AlF_4^-$ and $AlF_6^{3-}$ ions. Structurally, these melts are simpler than those of cryolites containing alumina.

Their ionic conductivity should be far better than cryolite-alumina melts because of the presence of plentiful $Na^+$, $Cl^-$, $F^-$ ions. As electrolytes they should sustain far higher current densities than those of cryolite-alumina melts that are now used in aluminum production.

As pointed out earlier, $AlCl_3$ on addition to the electrolyte should react with NaF forming $AlF_3$ and NaCl by reaction (7). As in the case of cryolite melts, $AlF_3$ should further react with $F^-$ by the reaction forming possibly $F_6^{3-}$ $$AlF_3 + 3F^- \rightarrow AlF_6^{3-} \quad (21)$$

Ion transport measurements indicate that $Na^+$ ions carry most of the current in the electrolysis of cryolite-alumina electrolytes used for producing aluminum at the present. Al metal is deposited on the cathode, by the reaction, $$3\ Na^+ + AlF_6^{3-} + e^- \rightarrow 3\ (Na^+ + F^-) + Al + 3F^- \quad (22)$$

In the $NaCl-NaF-Na_3AlF_6$ melts, and similar melts of the present invention, a similar reaction should occur at the cathode, involving the reduction of $AlF_4^-$ - instead of $AlF_6^{3-}$, as follows:

$$3\ Na^+AlF_4^-+3e^-\rightarrow 3\ (Na^{+F^-})+Al+F^- \quad (23)$$

At the anode, chlorine may be generated by the reaction, $$3NaCl+AlF_6^{3-}+F^-\rightarrow 3Na^++AlF_4^-+3F^-+1.5\ Cl_2+3e^- \quad (24)$$

Summation of $AlCl_3$ dissolution reaction (7) and (21), the cathode reaction (22), and anode reaction (23) gives the overall reaction (10). Similar arguments can be advanced for other electrolytes such as LiCl-LiF-$Li_3AlF_6$ melt, KCl-KF-$K_3AlF_6$ melt, and other similar melts.

Accordingly, a 25% energy saving in the aluminum production may be recognized by using aluminum trichloride as feed material. Currently, about one third of the capital investment and the plant are used for producing Soderberg anodes. Aluminum produced according to the invention eliminates the need for costly Soderberg anodes.

Millions of dollars are being spent in research and development to procure non-consumable anodes without much success. The process of the present invention employs a non-consumable graphite anode when using pure aluminum trichloride, or slightly consumable anode when using impure aluminum trichloride.

Finally, the process of the present invention requires fewer operations compared to existing aluminum production processes, thus simplifying the production of aluminum.

The disclosed embodiment is representative of a presently preferred form of the invention, but is intended to be illustrative rather than definitive thereof. The invention is defined in the claims.

I claim:

1. A method of producing aluminum comprising the steps of:

preparing a molten salt electrolyte solution in a reaction vessel comprising mixed metallic fluoride and chloride salts prepared from a ternary mixture of MCl-MF-$MAlF_6$ where M is an alkali metal element;

adding aluminum trichloride to the vessel and reacting the aluminum trichloride with the electrolyte solution to produce aluminum fluoride dissolved in the electrolyte solution; and electrolytically reducing the aluminum fluoride to produce aluminum.

2. The method of claim 1 wherein the alkali metal element is selected from the group consisting essentially of sodium, lithium, and potassium.

3. The method of claim 1 wherein the electrolyte solution comprises a ternary eutectic composition of NaCl-NaF-$Na_3AlF_6$.

4. The method of claim 1 wherein the electrolyte solution is selected from the group consisting essentially of NaCl-NaF-$Na_3AlF_6$, LiCl-LiF$Li_3AlF_6$, and KCl-KF-$K_3AlF_6$.

5. The method of claim 1 wherein a sufficient amount of the metallic fluoride salt is provided in the electrolyte solution to convert substantially all of the aluminum trichloride added to the vessel to aluminum fluoride.

6. A method of producing aluminum from aluminum trichloride starting material comprising the steps of:

preparing a molten electrolyte salt solution in a reaction vessel comprising a mixture of alkali metal chloride, alkali metal fluoride, and alkali metal cryolite selected from the group consisting of NaCl-NaF-$Na_3AlF_6$, LiCl-LiF-$Li_3AlF_6$, and KCl-KF-$K_3AlF_6$;

adding gaseous aluminum trichloride to the vessel and spontaneously reacting the aluminum trichloride with the alkali metal fluoride converting substantially all of the added aluminum trichloride to aluminum fluoride and an alkali metal chloride, the aluminum fluoride being dissolved in the electrolyte solution; and electrolytically decomposing the alkali metal chloride and aluminum fluoride to produce aluminum metal and an alkali metal fluoride.

7. The method of claim 6 wherein the electrolyte solution comprises NaCl-NaF-$Na_3AlF_6$ and the aluminum trichloride reacts with the electrolyte according to the reaction:

$AlCl_3+NaF\rightarrow AlF_3+NaCl$.

8. The method of claim 7 wherein the electrolytic reduction of $AlCl_3$ to Al occurs according to the reaction:

$3NaCl\rightarrow 3Na^++1.5Cl^-$, and $AlF_3+3Na^+\rightarrow 3NaF+Al$.

9. The method of claim 6 wherein the electrolyte solution comprises LiCl-LiF-$Li_3AlF_6$ and the aluminum trichloride reacts with the electrolyte according to the reaction:

$AlCl_3+LiF\rightarrow AlF_3+LiCl$.

10. The method of claim 9 wherein the electrolytic reduction of $AlCl_3$ to Al occurs according to the reaction:

$3LiCl\rightarrow 3Li^++1.5Cl^-$, and $AlF_3+3Li^+\rightarrow 3LiF+Al$.

11. The method of claim 6 wherein the electrolyte solution comprises KCl-KF-$K_3AlF_6$ and the aluminum trichloride reacts with the electrolyte according to the reaction:

$AlCl_3+KF\rightarrow AlF_3+KCl_3$.

12. The method of claim 11 wherein the electrolytic reduction of $AlCl_3$ to Al occurs according to the reaction:

$3KF\rightarrow 3K^++1.5Cl^-$, and $AlF_3+3K^+\rightarrow 3KF+Al$.

13. The method of claim 6 wherein there is sufficient amount of alkali metal fluoride present in the electrolyte solution to convert substantially all of the aluminum trichloride added to the vessel to aluminum fluoride.

* * * * *